US006715839B2

(12) United States Patent
Legal

(10) Patent No.: US 6,715,839 B2
(45) Date of Patent: Apr. 6, 2004

(54) DEVICE FOR LOCATING AND ATTACHING FABRIC TO RECEIVING FURNISHING, FURNITURE AND SEAT STRUCTURES

(75) Inventor: Yann Legal, Biviers (FR)

(73) Assignee: Lafuma, SA, Anneyron (FR)

( * ) Notice: Subject to any disclaimer, the term of this patent is extended or adjusted under 35 U.S.C. 154(b) by 0 days.

(21) Appl. No.: 10/430,606

(22) Filed: May 6, 2003

(65) Prior Publication Data

US 2003/0209935 A1 Nov. 13, 2003

(30) Foreign Application Priority Data

May 7, 2002 (FR) ..... 02 05934

(51) Int. Cl.[7] ..... A47C 7/02; A47C 4/28

(52) U.S. Cl. ..... 297/452.63; 297/452.56; 297/31

(58) Field of Search ..... 297/452.63, 452.56, 297/31

(56) References Cited

U.S. PATENT DOCUMENTS

| | | | | |
|---|---|---|---|---|
| 2,729,279 A | | 11/1956 | Axtell et al. | |
| 2,856,990 A | * | 10/1958 | Thomas | 297/452.63 X |
| 3,088,517 A | * | 5/1963 | Schwartz et al. | 297/452.63 X |
| 3,114,578 A | * | 12/1963 | Hamilton | 297/452.63 |
| 3,179,469 A | * | 4/1965 | Heuston | 297/452.56 |
| 3,363,667 A | * | 1/1968 | Thomas et al. | 297/452.63 X |
| 5,445,436 A | * | 8/1995 | Keminitz | 297/452.63 |
| 5,645,321 A | * | 7/1997 | Seroldi | 297/452.63 |

FOREIGN PATENT DOCUMENTS

| | | |
|---|---|---|
| EP | 0 925 745 | 6/1999 |
| GB | 866 741 A | 4/1961 |
| GB | 1 104 276 A | 2/1968 |
| IT | VI94U000041 | 8/1994 |
| NL | 298 637 A | 5/1964 |

* cited by examiner

*Primary Examiner*—Peter R. Brown
*Assistant Examiner*—Rodney B. White
(74) *Attorney, Agent, or Firm*—Ruben C. DeLeon

(57) ABSTRACT

This device is noteworthy in that it comprises a band (3) made of a plastics material attached to the outer border or borders of the fabric (1), said band having at least one shaped molded tab **(3*a*)** integral with the band, said tab having the shape of a supporting cradle so as to be inserted against the opposing wall of the side member of the supporting structure, and in the intervals formed between said side member and a strip attached to said side member, and in that the area of the join between the band and the tab constitutes an area of resistance capable of taking the pressure of an undulating part of the strip, thereby enabling the tab to be locked in position relative to the opposing side member.

4 Claims, 4 Drawing Sheets

FIG. 4
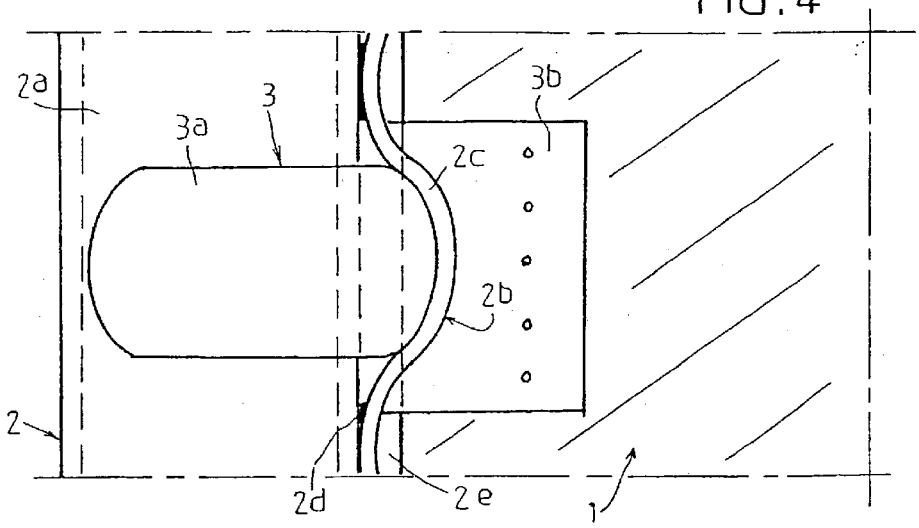
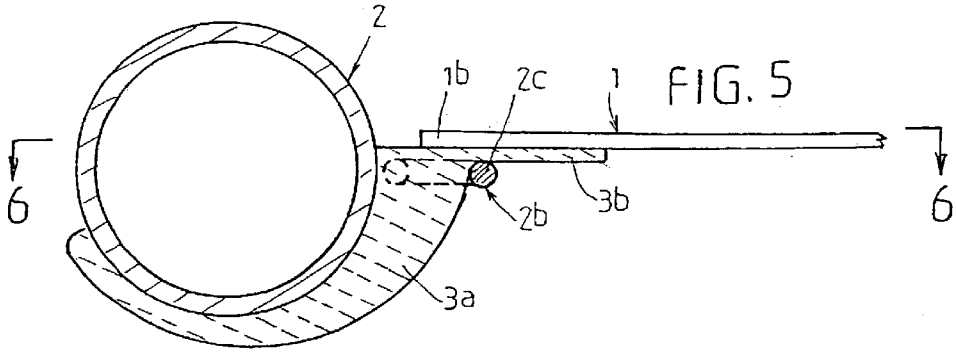
FIG. 5
FIG. 6
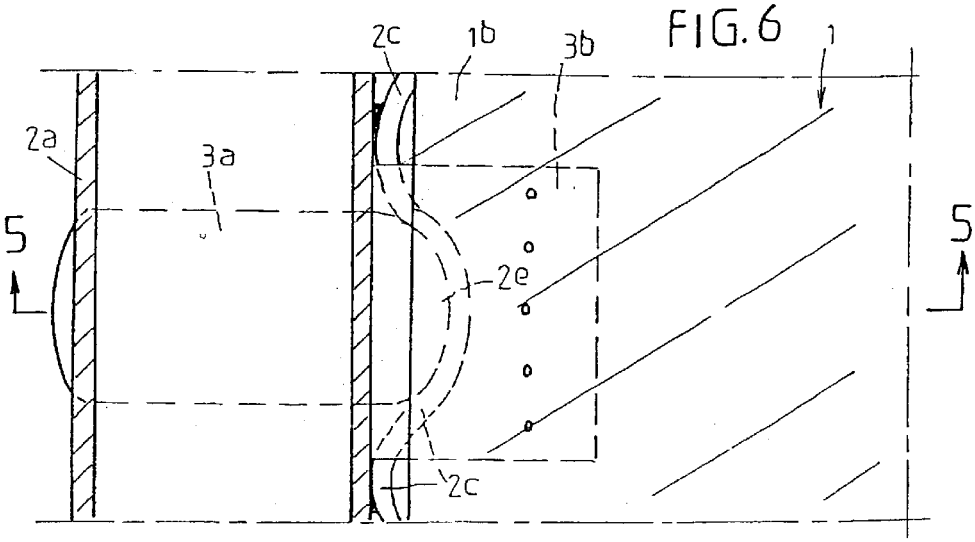

DEVICE FOR LOCATING AND ATTACHING FABRIC TO RECEIVING FURNISHING, FURNITURE AND SEAT STRUCTURES

This application claims priority to French Application No. 02 05934 filed on May 7, 2002.

TECHNICAL FIELD OF THE INVENTION

The invention relates to furniture and furnishings such as seats, armchairs and beds that can be used not only in daily use situations of ordinary home life but also on limited or temporary occasions, during the vacation period or for leisure use.

In other words the seats, armchairs, beds and similar objects can be used as accessories for camping, walking, weekend leisure activities or simply at home.

BACKGROUND

Referring now to FIG. 1, the prior art has long included furniture forming seats known as reclining armchairs, consisting of rigid parallel side members, sometimes forming closed U-shaped frames with supporting fabric stretched on and between them and attached by elastic means. In the embodiment shown in FIG. 1, which the applicant has in particular marketed for many years, the elastic means, which are of the tensioning type, are threaded through a series of eyelets formed for this purpose in the edges of the fabric, and hooks or the like provided for this purpose on the side members so that the tensioner can be threaded back and forth in a zigzag pattern from eyelet to hook. In practice the successive hooks are made from a zigzag undulating wire, with portions welded to the inside generatrix of the side member, defining between two successive connected portions an opening for the insertion of the tensioner or other means of attachment of the same type. In the prior art reviewed above, the problem lies in the costs of fabrication and assembly of the element connecting the fabric to the supporting framework. Clearly, threading the tensioners through the eyelets and hook shapes is slow, fine work and not very practical. It continues to be done by hand only as it is difficult to devise a means of threading first in one direction and then in the other with manipulator arms or the like by way of automation on either side of the longitudinal plane represented by the supporting framework. However, the advantage of this construction is that the tensions applied to the fabric are balanced.

The MARGA Italian patent No. VI94U000041 discloses another fabric tensioning system. Here an extra bar is fixed to the interior of the metal frame and the lateral edges of the cloth or fabric are attached by means of elastic cord passing through a plurality of eyelets formed in the edges of the fabric and retained by a plurality of hooks, each hook coming between two successive eyelets on the abovementioned bar. This construction is more complex. Its only advantage is that the elastic cord can be fed through said eyelets, and then, afterwards, the parts of the elastic cords that can be displaced sideways are hooked over the associated hooks on the abovementioned bar. This construction is not however very satisfactory.

OBJECTS OF THE INVENTION

The object of the invention is therefore to research and devise a fabric attaching, connecting and laying device that will be easy to produce, easy for the operator to handle and of a limited manufacturing cost compared to the prior art.

Another object of the invention is to devise a device which, while being easy to position to connect the fabric to the supporting framework, performs a complete locking or self-locking function, so that the seat is then absolutely safe to use.

Another object of the invention is to devise a device that can be partly replaced in the event of deterioration, without reducing the support provided to the fabric by the supporting framework.

In accordance with a first feature of the invention, the device for locating and attaching a fabric to a supporting receiving furnishing furniture and seat structure, said structure comprising at least one side member to which is presented and attached a zigzag undulating wire strip defining open intervals for the passage of means of connection, is noteworthy in that it comprises a band made of a plastics material attached to the outer border or borders of the fabric, said band having at least one shaped molded tab integral with the band, said tab having the shape of a supporting cradle so as to be inserted against the opposing wall of the side member of the supporting structure, and in the intervals formed between said side member and a strip attached to said side member, and in that the area of the join between the band and the tab constitutes an area of reaction capable of taking the pressure of an undulating part of the strip, thereby enabling the tab to be locked in position relative to the opposing side member.

These features and others also will be shown clearly in the remainder of the description.

BRIEF DESCRIPTION OF THE DRAWINGS

In order to provide a clear idea of the subject of the invention, illustrated in a non-restrictive manner in the figures of the drawings in which:

FIG. 4 is a partial view from beneath illustrating the positioning of the device;

FIG. 5 is a partial sectional view on 5—5 as marked in FIG. 6; and FIG. 6 is a partial sectional view on 6—6 as marked in FIG. 5.

DETAILED DESCRIPTION

While the making and using of various embodiments of the present invention are discussed in detail below, it should be appreciated that the present invention provides many applicable inventive concepts that may be embodied in a wide variety of specific context. The specific embodiments discussed herein are merely illustrative of specific ways to make and use the invention and do not delimit the scope of the invention.

In order to render the subject of the invention more concrete, it will now be described in a non-restrictive manner illustrated in the figures of the drawings.

Figure 1:
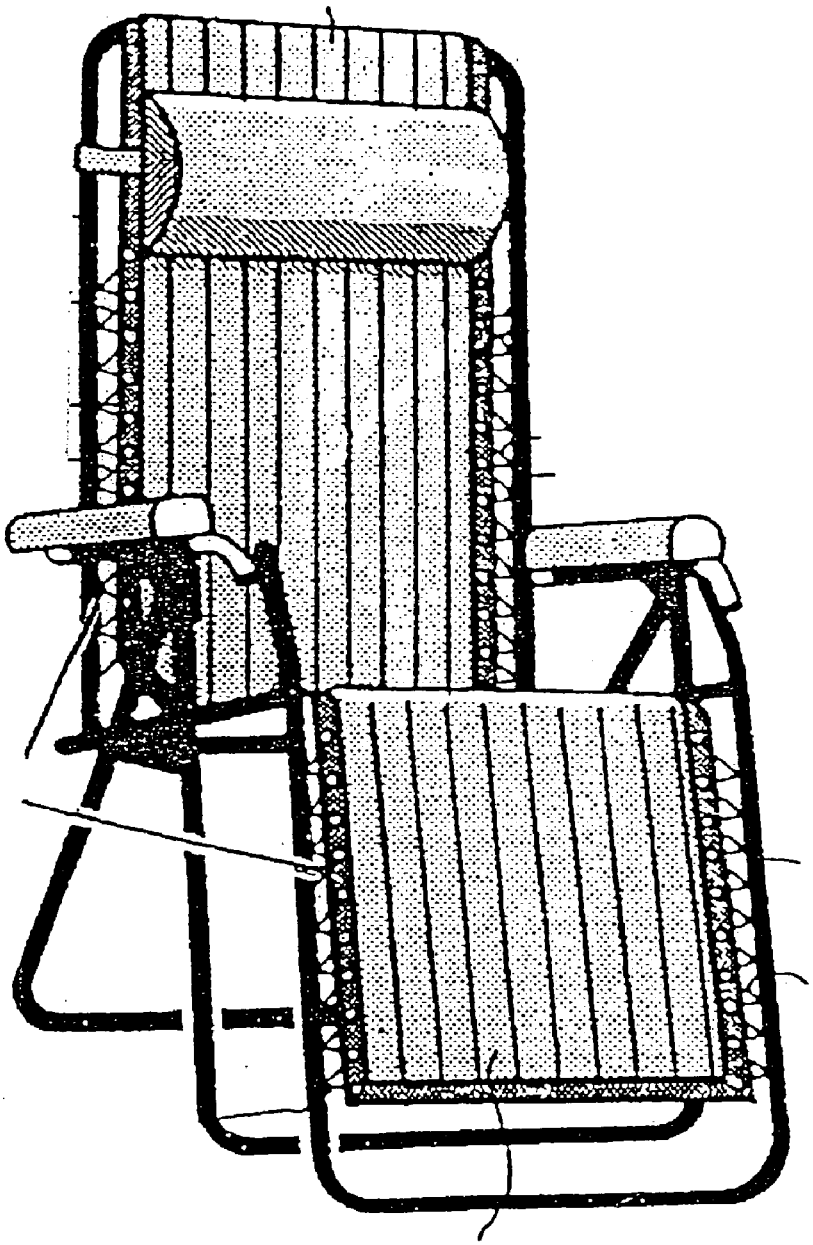
FIG. 1 is a perspective view of a reclining chair according to the prior art.
Figure 2:
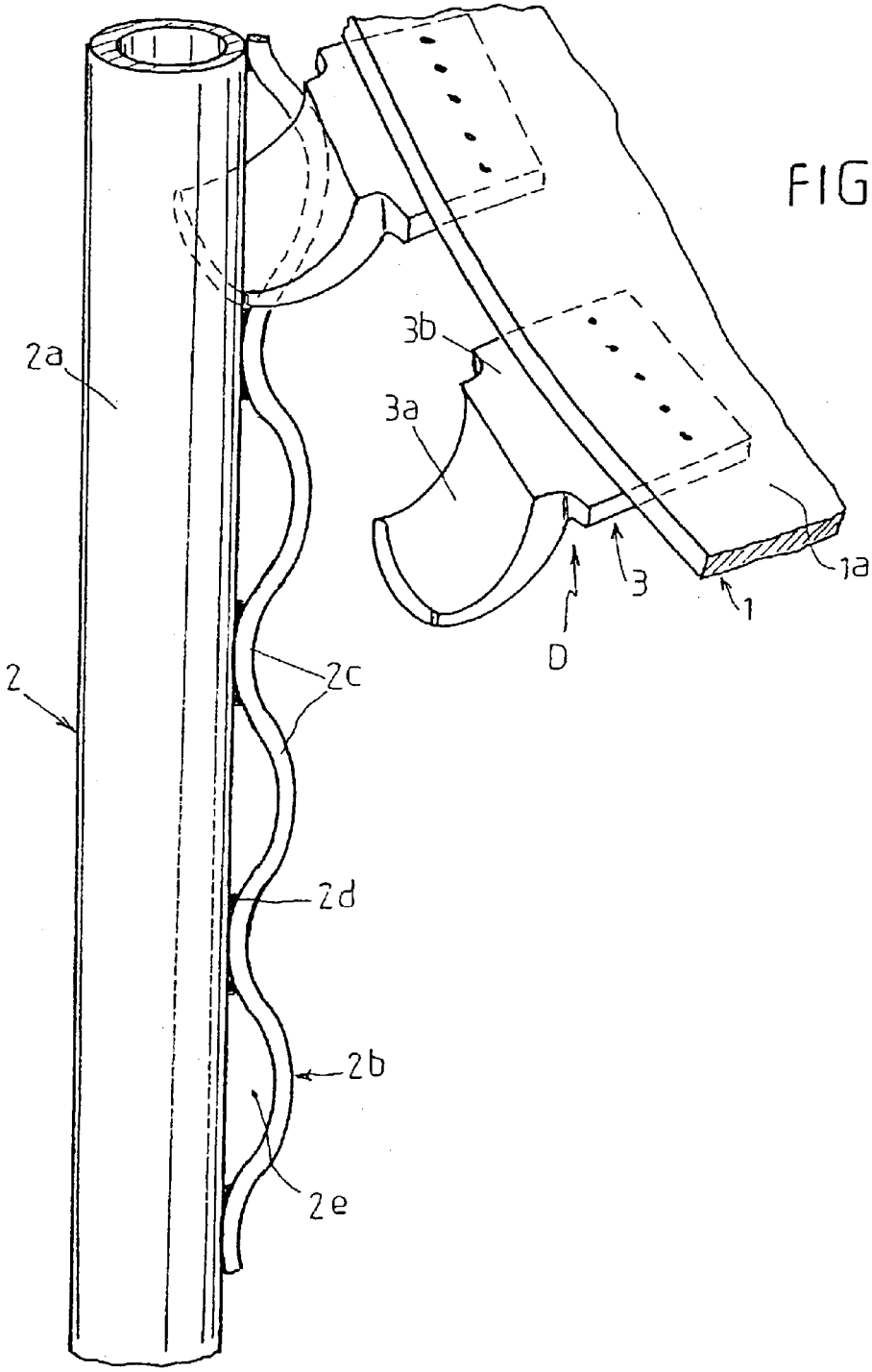
FIG. 2 is a large-scale partial view of the device according to the invention for applying a fabric to a supporting framework.
Figure 3:
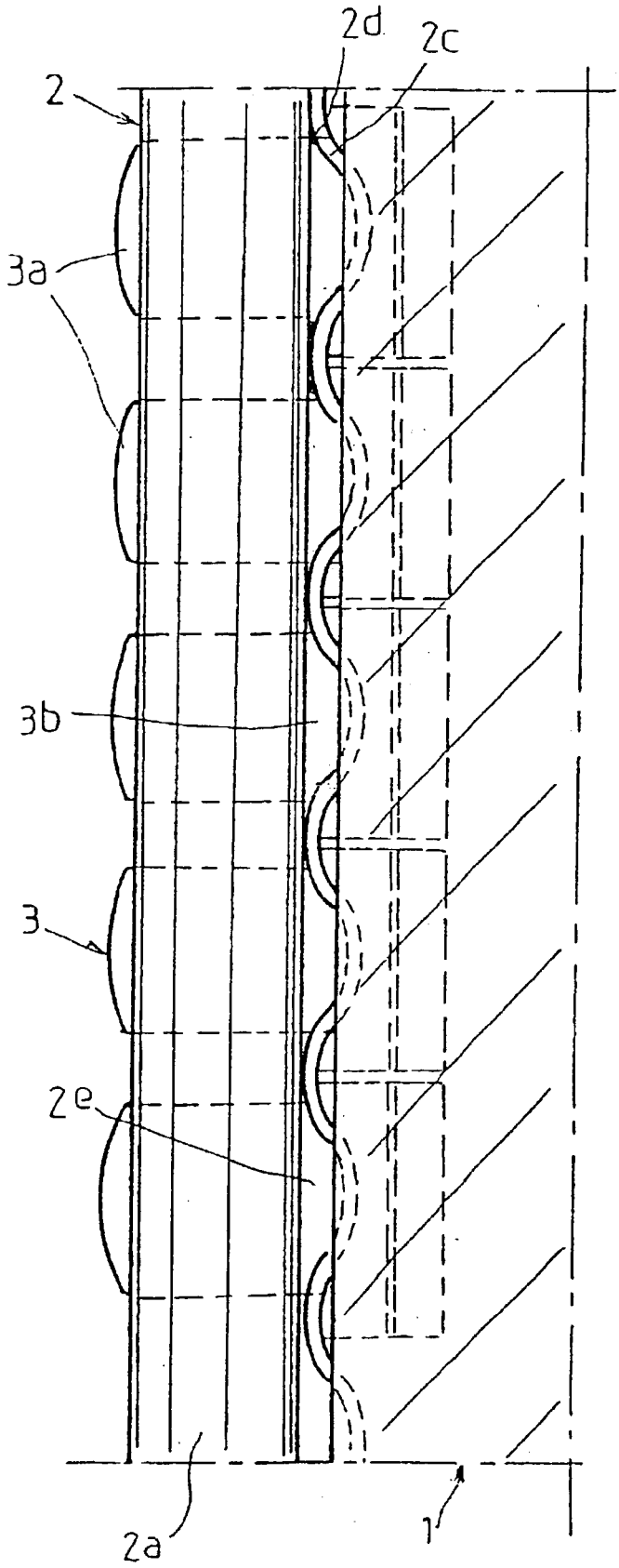
FIG. 3 is a top plan view illustrating the positioning of a fabric relative to a supporting framework in the position of tension.

Referring now to FIG. 2, the purpose of the invention is to provide a device (D) for the connection and positioning of a fabric (1) designed to be stretched over a piece of furniture or furnishing such as a seat, chair, bed or the like. The fabric can have any configuration and be of any appropriate material. The supporting structure (2) may be made from one or more side members (2*a*) that may be tubular or otherwise, and rigid, parallel and closed or open, forming a frame and possessing in a known manner on the edge and the longitudinal central inward generatrix a strip (2*b*) in the form of a continuous or discontinuous wire comprising a plurality of zigzagging undulations (2*c*). These undulations form, in one plane, portions (2*d*) for connection to the side member by welding or other means and define, between two portions connected to said abovementioned tube or side member, passages or open intervals (2*e*) which may act as hook engagement regions.

As a variant and without departing from the scope of the invention, the supporting structure may be made of wood or thermoformed or injection-molded plastics material, the side member and associated strip being incorporated directly in this embodiment. The form of the strip (2*b*) may vary, the important point being that it forms through openings with respect to the side member.

According to the invention the device comprises a band (3) made of a plastics material overmolded onto the outer border or borders (1*a*, 1*b*) of the fabric or capable of being stitched onto it. At the end of this band is a molded shaped tab (3*a*) designed to form a cradle that will press against the opposing wall of the corresponding tubular side member. The adjacent flat part (3*b*) surrounding each of said tabs (3*a*) may also act as an area of reaction capable of taking the pressure of the opposing undulating part of the abovementioned strip (2*b*). The attached band (3) may be established in the form of a module with one tab only, or may be made longer and provided with several tabs of the abovementioned type at successive intervals for engagement in the open intervals (2*e*) formed in the passages of the undulations of the strip (2*b*) attached to the supporting side member. Notice also that the tabs (3*a*) are given a profile that corresponds to said side member, so as to provide even reaction between the side member and the part of the attached band which may or may not be overmolded, or stitched to the fabric.

Referring now to FIGS. 3–6, according to the invention the device comprises a band (3) made of a plastics material overmolded onto the outer border or borders (1*a*, 1*b*) of the fabric or capable of being stitched onto it. At the end of this band is a molded shaped tab (3*a*) designed to form a cradle that will press against the opposing wall of the corresponding tubular side member. The adjacent flat part (3*b*) surrounding each of said tabs (3*a*) may also act as an area of reaction capable of taking the pressure of the opposing undulating part of the abovementioned strip (2*b*). The attached band (3) may be established in the form of a module with one tab only, or may be made longer and provided with several tabs of the abovementioned type at successive intervals for engagement in the open intervals (2*e*) formed in the passages of the undulations of the strip (2*b*) attached to the supporting side member. Notice also that the tabs (3*a*) are given a profile that corresponds to said side member, so as to provide even reaction between the side member and the part of the attached band which may or may not be overmolded, or stitched to the fabric.

When put together, the suspension of the system is rigid, firm and locked. Only an operator can detach or move one of the tabs of the device to release it. Thus constructed the device is much safer. Implementation and manufacturing costs are much reduced because the band is produced by continuous injection-molding or thermoforming and cut up into the desired lengths. The connection between the band and the fabric on each side is effected by ultrasound welding, sewing, stitching or the like.

Should one of the tabs be damaged and broken, for example, it could easily be changed and a length of band could easily be replaced by detaching it from the fabric at the corresponding point.

The invention has numerous applications in receiving furnishing and furniture structures such as seats, chairs, beds and the like, for all uses and leisure or other circumstances.

What is claimed is:

1. A device for locating and attaching a fabric to a supporting receiving furnishing furniture and seat structure, said structure comprising at least one side member to which is presented and attached a zigzag undulating wire strip defining open intervals for the passage of means of connection, which device comprises a band (3) made of a plastics material attached to the outer border or borders of the fabric (1), said band having at least one shaped molded tab (3*a*) integral with the band, said tab having the shape of a supporting cradle so as to be inserted against the opposing wall of the side member of the supporting structure, and in the intervals formed between said side member and a strip attached to said side member, the area of the join between the band and the tab constituting an area of reaction capable of taking the pressure of an undulating part of the strip, thereby enabling the tab to be locked in position relative to the opposing side member.

2. The device as claimed in claim 1, in which the band (3) is overmolded along the outer border of the fabric.

3. The device as claimed in claim 1, in which the band (3) is an added piece stitched along the outer border of the fabric.

4. The device as claimed in any one of claims 1 to 3, in which the band (3) is established in the form of a module that includes at least one tab (3*a*).

* * * * *